United States Patent [19]

Chi

[11] Patent Number: 4,618,328

[45] Date of Patent: Oct. 21, 1986

[54] SWIMMING GLOVE

[76] Inventor: Hsin-Hsiung Chi, No. 387, Ta Nan Road, Shih Lin District, Taipei, Taiwan

[21] Appl. No.: 815,814

[22] Filed: Jan. 2, 1986

Related U.S. Application Data

[63] Continuation-in-part of Ser. No. 647,843, Sep. 6, 1984, abandoned.

[51] Int. Cl.[4] ..... A63B 31/04

[52] U.S. Cl. ..... 441/57; 441/58

[58] Field of Search ..... 441/57, 58, 56; D21/237, 238, 239; 2/159, 161 A, 163, 168

[56] References Cited

U.S. PATENT DOCUMENTS

| | | | |
|---|---|---|---|
| 1,014,939 | 1/1912 | Boman | 441/58 |
| 2,004,684 | 6/1935 | Bell | 441/57 |
| 2,304,010 | 12/1942 | Myers | 441/58 |
| 3,257,673 | 6/1966 | Rademacher | 441/58 |
| 4,058,863 | 11/1977 | Ferdico | 441/57 |

FOREIGN PATENT DOCUMENTS

| | | | |
|---|---|---|---|
| 1514778 | 2/1968 | France | 441/57 |
| 683004 | 2/1965 | Italy | 441/57 |

*Primary Examiner*—Sherman D. Basinger

*Attorney, Agent, or Firm*—Shoemaker and Mattare, Ltd.

[57] ABSTRACT

A swimming glove composed of five finger sleeves having a web in between each two neighboring finger sleeves, each finger sleeve having an end opening and at least one pair of side openings. The glove also has a palm side and a back side respectively provided with central openings, and an edge part provided with a third opening. A pair of fastening straps adapted to extend transversally across the hand of the wearer is provided to leave the wrist portion free from restraint. The glove is capable of making swimming and diving easier and also allowing the free movement of the fingers and the hand of the wearer of the glove.

2 Claims, 5 Drawing Figures

SWIMMING GLOVE

This application is a continuation-in-part application of U.S. patent application No. 647,843 filed on Sept. 6, 1984, which is now abandoned.

BACKGROUND OF THE INVENTION

To make swimming or diving easier there are various accessories, such as foot fins and swimming gloves, for swimmers to wear. Conventional swimming gloves are either made of a relatively inflexible material that hinders the hands or fingers from free movement, or are made in such forms as to cover tightly the whole palm and wrist so as to make the wearer feel uncomfortable and awkward.

The inventor has reviewed the construction of the swimming gloves proposed in U.S. Pat. Nos. 2,004,684; 2,304,010; 4,058,863; 1,014,939;-and 3,257,673; as well as those taught in Italian Pat. No. 683004 and French Pat. No. 1514778.

U.S. Pat. No. 2,004,684 shows a swimming glove having fingers joined together by flexible imperforate webs, an imperforate plam portion, a back face with rectangular opening, and an elastic wrist band adapt to fit the wrist of the wearer.

U.S. Pat. No. 2,304,010 shows a swimming mit having four finger stalls and one thumb stall, the finger stalls and thumb stall being connected by intervening webs; wherein the finger stalls and thumb stall have base ends provided with integral reinforcing strips with are connected to a circular header adapted to seat against the back of the hand of the wearer; the circular header is also provided with tie strings to be tied around the wrist of the wearer for securing the swimming mit in position.

U.S. Pat. No. 4,058,863 shows a swimming glove having five digit receiving portions including finger receiving portions and a thumb receiving portion, each digit receiving portion being interconnected to one another by a plannar web portion; the swimming glove is provided with a wrist encircling portion adapted to fit around the wrist of the wear so as to secure the glove onto the hand of the wearer.

U.S. Pat. No. 1,014,939 shows a hand attachment for swimming, having fingers formed in one piece of rubber material, each finger being provided with holes shaped to allow the knuckles to move freely when the hand is shut, the attachment being connected to a wrist band with straps, the wrist band being adapted to fit around the wrist of the wearer.

U.S. Pat. No. 3,257,673 shows a swimming glove which is similar to that of U.S. Pat. No. 1,014,939, except for the web formed with a plurality of fore and aft grooves in parallel with the fingers and thumb. This patent also employs wrist band 13 connected to the thumb with a pair of straps, so as to secure the glove onto the wrist of the wearer.

Italian Pat. No. 683004 shows a swimming glove having four fingers and one thumb connected with webs, the fingers and thumb being further connected to a wrist band with straps.

French Pat. No. 1514778 shows a swimming glove with a wrist band.

All of the swimming gloves of the abovementioned patents are provided with a wrist band or a wrist encircling member for securing the glove onto the wrist of the wearer. As the wrist band is connected to either the fingers or the thumb of the glove by straps or by an integral part of the glove, movement of the fingers or the thumb of the wearer is still restrained.

In view of the aforesaid problems with conventional swimming gloves, this invention offers an improved swimming glove that allows the hand and fingers of the wearer to move more freely and to further minimize the uncomfortableness and awkwardness of the wearer.

SUMMARY OF THE INVENTION

This invention presents a swimming glove made of resilient and flexible material, comprising five finger sleeves corresponding to the thumb and fingers of the wearer, and a glove body having a palm side and back side both symmetrically provided with a relatively large opening. Between each two neighboring finger sleeves there is formed a flexible web, and each finger sleeve is provided with an end opening that permits the finger tip to extend therethrough and side openings to correspond to the joint of the thumb as well as the joints of the respective fingers to enable the easy bending of the thumb and fingers of the wearer. The glove is further provided with a pair of fastening straps integrally formed with the glove body, the fastening straps being arranged to extend transversally accross the hand of the wearer to leave the wrist of the wearer free from restraint.

DETAILED DESCRIPTION OF THE INVENTION

Figure 1:
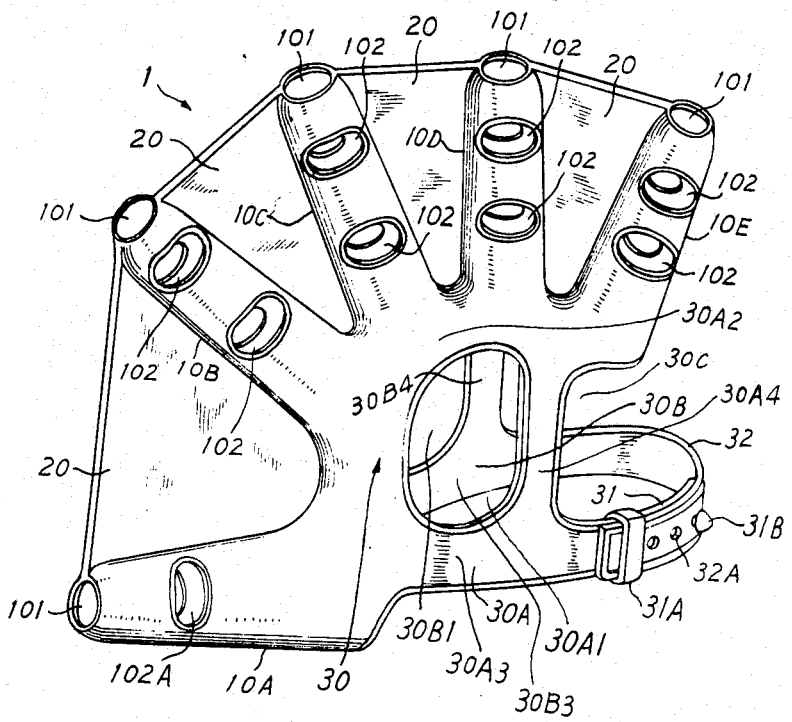
FIG. 1 is an oblique, perspective view of an embodiment of the swimming glove of this invention.

As shown in FIG. 1, swimming glove 1 of this invention comprises five finger sleeves 10A–10E, to correspond with the thumb and fingers of one human hand, webs 20—20 formed in the space between each two neighboring finger sleeves, a glove body 30 integrally formed with finger sleeves 10A–10E and a pair of fastening straps 31, 32 integrally formed with glove body 30. Each finger sleeve is provided with an end opening 101 to permit the finger tip to extend therethrough in case the wearer has exceptionally long fingers, and side openings 102A or 102—102 to correspond to the finger joints of the respective fingers. In other words, first finger sleeve 10A, which corresponds to a thumb having one finger joint, is provided with one pair of side openings 102A, while each one of the remaining four finger sleeves 10B–10E is provided with two pairs of side openings 102—102, so as to faclitate the bending of the fingers of the wearer of the glove without being restrained.

Swimming glove 1 is made of stretchable, flexible and resilient material such as natural rubber or synthetic rubber so as to enable the free movement of the fingers of the wearer.

Glove body 30 has a first side 30A and a symmetric, opposite, second side 30B. Each side is provided with a relatively large central opening 30A1, or 30B1, defined by the base portions 30A2 of second, third and fourth finger sleeves 10B, 10C, 10D, and longitudinal strap 30A4 or 30B4, as well as transversal strap 30A3 or 30B3. Glove body 30 is further provided with an edge opening 30C at the edge opposite to first finger sleeve 10A.

Transversal strap 30A3 or 30B3, which is an integral part of glove body 30, extends from the base portion of first finger 10A and is arranged to pass across the palm, or the back, of the hand of the wearer, to join with longitudinal strap 30A4 or 30B4, and further extends to form fastening strap 31 or 32.

Figure 2:
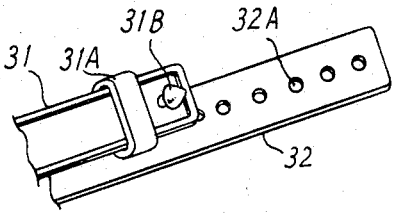
FIG. 2 is a fragmentary perspective view of the pair of fastening straps of the swimming glove of FIG. 1, showing a disconnected state.
Figure 3:
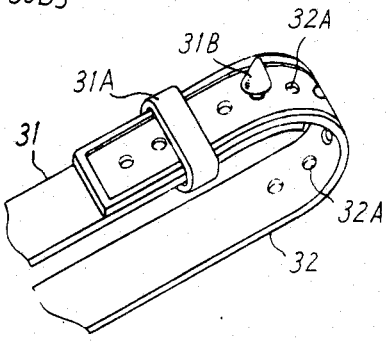
FIG. 3 is a fragmentary perspective view of the pair of fastening straps of the swimming glove of FIG. 1, showing a fastened state.
Figure 4:
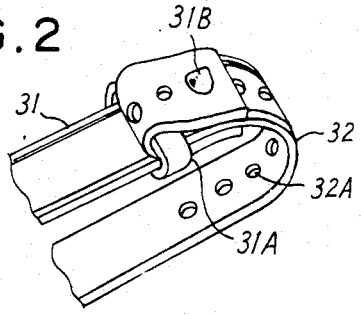
FIG. 4 is a fragmentary perspective view of the pair of fastening straps of the swimming glove of FIG. 1, showing another fastened state.

The pair of fastening straps 31, 32 as shown in FIG. 2 has a first strap 31 provided with a button 31B, and a second strap 32 provided with a series of holes 32A to selectively fit button 31B of first strap 31. First strap 31 is further provided with a ring 31A at a suitable distance from button 31B so as to receive the end part of second strap 32 when the pair of straps 31, 32 is fastened, as shown in FIG. 3. The end part of second strap 32 when passed through ring 31A may be folded back over ring 31A and secured by button 31B, which has already passed through a hole 32A, by engaging a selected hole in the end part of second strap 32 with button 31B, so as to assure that the straps will not accidentily come apart.

Figure 5:
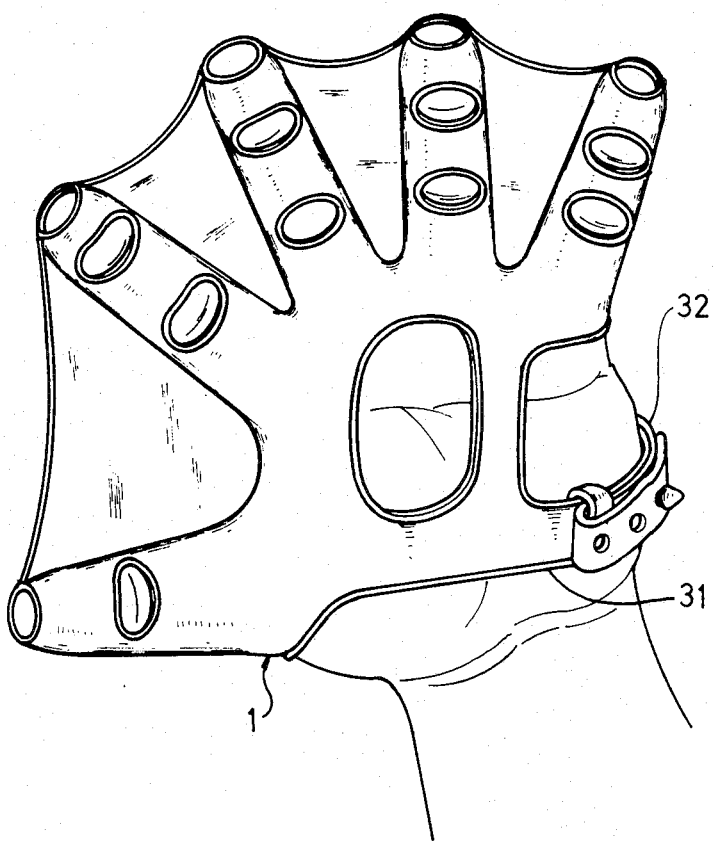
FIG. 5 is an oblique, perspective view of the swimming glove of FIG. 1 being put on hand.

In use, the swimming glove is fitted on the hand of the swimmer, with the pair of fastening straps 31, 32 tied around the side edge opposite the thumb of the wearer's hand, as shown in FIG. 5, leaving the base part of the hand and the wrist of the wearer completely free from restraint. This arrangement of the fastening straps as well as the formation of the end openings of the finger sleeves enable the swimming glove to fit hands of any size. The formation of side openings of the finger sleeves facilitate bending of the thumb and fingers of the wearer. The central openings and the side edge opening relieve the hand from restraint, thus further easing the movement of the hand and fingers of the wearer. The symmetrical formation of the two sides of the swimming glove makes a pair of the gloves interchangeable with each other.

Although a preferred embodiment of the swimming glove has been illustrated and described by way of example, it should be understood that the construction of the swimming glove of this invention can be modified otherwise. For example, the pair of straps may be of any conventional type. The scope and spirit of this invention are defined in the appended claims.

What is claimed is:

1. A swimming glove comprising five finger sleeves corresponding with the thumb and four fingers of a wearer of the swimming glove, said five finger sleeves having a web in between each two neighboring finger sleeves, each finger sleeve having an end opening and at least one pair of opposite side openings to correspond with a finger joint to enable easy bending of the wearer's fingers;

a glove body integrally formed with said finger sleeves and webs, said glove body having a first side and an opposite, symmetric second side respectively provided with first and second central openings, and a third opening along one edge part of said glove body; and a pair of fastening straps integrally formed with said glove body and arranged to extend traversally across the wearer's hand and to be tied around the side edge of the wearer's hand opposite the thumb.

2. The swimming glove defined in claim 1, wherein four of said five sleeves corresponding to the four fingers of the wearer are each provided with two pairs of opposite side openings to correspond with respective finger joints.

* * * * *